United States Patent [19]

Stella

[11] Patent Number: 4,623,236

[45] Date of Patent: Nov. 18, 1986

[54] PHOTOGRAPHIC PROCESSING COMPOSITION APPLICATOR

[75] Inventor: Joseph A. Stella, Peabody, Mass.

[73] Assignee: Polaroid Corporation, Cambridge, Mass.

[21] Appl. No.: 793,177

[22] Filed: Oct. 31, 1985

[51] Int. Cl.[4] ..... G03D 5/06

[52] U.S. Cl. ..... 354/318; 354/317

[58] Field of Search ..... 354/317, 318, 303, 305; 118/110, 119, 243, 244, 263, 258

[56] References Cited

U.S. PATENT DOCUMENTS

| | | | |
|---|---|---|---|
| 2,435,719 | 2/1948 | Land . | |
| 2,933,033 | 4/1960 | Judge | 354/318 |
| 3,307,468 | 3/1967 | Briber . | |
| 3,453,138 | 7/1969 | Chen et al. | 117/111 |
| 4,307,955 | 12/1981 | Cocco et al. | 354/303 |
| 4,566,772 | 1/1986 | Sulesky et al. | 354/318 |

*Primary Examiner*—A. A. Mathews

*Attorney, Agent, or Firm*—Alfred E. Corrigan

[57] ABSTRACT

An applicator for applying a photographic processing composition to a length of sheet material. The applicator includes a reservoir for containing a supply of photographic processing composition in a substantially non-oxidative environment, and an elongate member mounted for axial movement for transferring a predetermined quantity of the processing composition from the reservoir to the exterior of the applicator whereat the processing composition is applied as a coating to the sheet material.

11 Claims, 9 Drawing Figures

PHOTOGRAPHIC PROCESSING COMPOSITION APPLICATOR

BACKGROUND OF THE INVENTION

1. Field of the Invention

The invention relates to an applicator for applying a coating of an oxidizable photographic processing composition to a surface of a length of sheet material so as to initiate the formation of a visible image therein or in a length of exposed film which is to be subsequently superposed therewith.

2. Description of the Prior Art

The present invention relates to an applicator for applying a coating of a photographic processing composition, preferably in the form of a viscous liquid, to a length of sheet material prior to superposing it with a length of exposed film so as to initiate the transformation of a latent photographic image into a visible image. Alternatively, the sheet material may contain the latent photographic image and the visible image may be formed in the same sheet material or in a subsequently superposed sheet material. Examples of such applicators may be found in U.S. Pat. Nos. 4,307,955; 3,453,138; 3,307,468; and 2,435,719. In the U.S. Pat. No. 4,307,955 the applicator is adapted to apply a coating of a photographic processing composition to a length of sheet material prior to superposing it with a length of photographically exposed film so as to initiate the formation of a visible image in the film. The applicators described in the U.S. Pat. Nos. 3,453,138 and 3,307,468 apply such a coating to an exposed length of sheet material (film) so as to develop the latent images contained therein. The applicator described in the U.S. Pat. No. 2,435,719 patent includes a plunger-cylinder combination for dispensing drops of a viscous processing liquid between lengths of positive and negative materials prior to their introduction between a pair of spread rollers.

Generally, the photographic processing compositions used in applicators of the type described take the form of a liquid which is alkaline and as such is subject to aerial oxidation. Accordingly, measures must be taken to protect the processing liquid from evaporation as well as the oxygen in the surrounding atmosphere when the applicator is adapted for intermittent operation, vis-a-vis, the one time operation of the applicator in the U.S. Pat. No. 4,307,955. The applicator of the U.S. Pat. No. 2,435,719 provides some protection against the adverse affects of the atmosphere but, because of the design of it plunger, also provides a system in which substantially all of the processing liquid located in its cylinder may not be expressed therefrom during each operation of the plunger. Thus, the processing liquid which remains in the cylinder at the end of each stroke of the plunger (due to the segmented end of the plunger) is subjected to the contaminating affects of the atmosphere until the applicator's outlet is sealed. This processing liquid is then mixed with a new supply of processing liquid during each of the following operating cycles thereby possibly decreasing its ability to contribute to the proper formation of a visible image in a subsequently impregnated sheet material. The applicator of U.S. Pat. No. 3,453,138 has a liquid reservoir which relies upon a transfer roller and a pair of resilient doctor blades for maintaining its air tightness and for preventing the escape of the processing liquid. However, since it appears that a portion of the aforementioned transfer roller will always contain some liquid on its surface at the end of each coating operation, it would appear that this portion would become contaminated by the atmosphere and such contamination would be at least partially transferred to the liquid in the reservoir during subsequent coating cycles. Finally, the applicator described in the U.S. Pat. No. 3,307,468 provides an arrangement wherein an applicator roller is initially submerged within a processing liquid contained within a reservoir. The reservoir has a cover mounted for movement from an open position to a closed position wherein it provides some protection for the processing liquid against the adverse affects of the atmosphere. During a coating operation, the cover is opened and the applicator roller is partially raised from the processing liquid and rotated about its axis in contact with a length of sheet material so as to apply a coating of the processing liquid thereto. But, at the end of the coating operation, the applicator roller is returned to its original submerged position within the reservoir without its surface being cleaned, thus possibly contaminating the processing liquid.

SUMMARY OF THE INVENTION

The present invention relates to an applicator for applying a coating of a photographic processing composition to a length of flexible sheet material, and more particularly to an applicator which will protect the photographic processing composition from the oxidizing affects of the ambient atmosphere. In a preferred embodiment, the applicator includes a housing having a reservoir for containing a supply of photographic processing composition, preferably a viscous liquid, in a non-oxidative environment. Slidably mounted within a passageway in the housing is an elongate member in the form of a cylinder or roller. The surface of the roller is recessed intermediate its ends so as to provide a means for receiving a predetermined quantity of the processing composition. The roller is coupled to an actuating mechanism which is adapted to axially and rotationally move the roller along and then about its longitudinal axis from a first position, wherein the recessed portion is located within the reservoir and is filled with the processing composition, to a second position, wherein the recessed portion is removed from the housing and has been rotated through an angle of approximately ninety degrees such that the processing composition contained therein may flow therefrom under the force of gravity and be coated on a length of sheet material located thereunder. The coated length of sheet material is then superposed with a length of photographically exposed film to thus enable the coating of processing composition to impregnate the film and initiate the formation of a visible image. Several alternative embodiments are also described hereinafter.

An object of the invention is to provide an applicator for a photographic processing composition which includes a member for carrying a quantity of the composition from a substantially non-oxidative environment within the applicator to the exterior of the applicator whereat it applies the composition as a coating to a length of sheet material.

Another object of the invention is to provide an applicator of the type described which does not physically contact the sheet material being coated with the processing composition.

Other objects of the invention will in part be obvious and will in part appear hereinafter.

The invention accordingly comprises the apparatus possessing the construction, combination of elements, and arrangement of parts which are exemplified in the following detailed disclosure, and the scope of the application of which will be indicated in the claims.

BRIEF DESCRIPTION OF THE DRAWINGS

For a fuller understanding of the nature and objects of the invention, reference should be had to the following detailed description taken in connection with the accompanying drawings wherein.

DETAILED DESCRIPTION OF THE INVENTION

Figure 1:
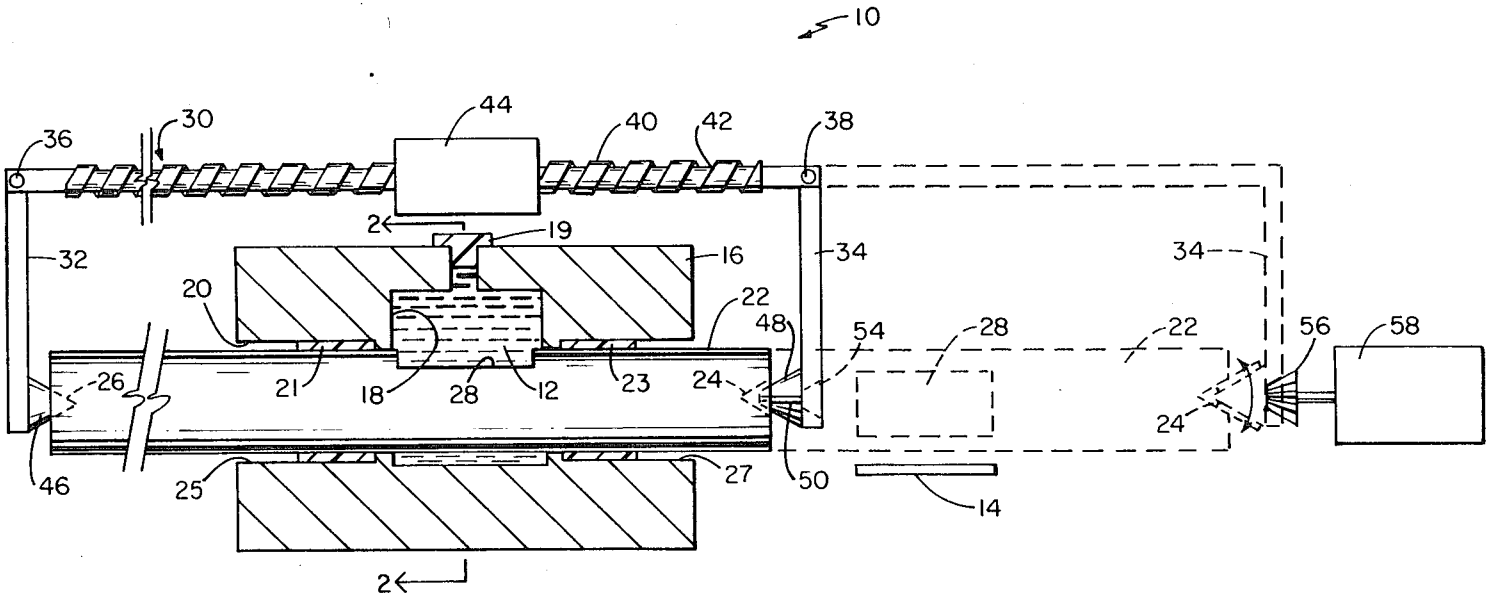
FIG. 1 is a side elevational view, partly in section, showing a preferred embodiment of an applicator for applying a coating of a photographic processing composition to a length of sheet material.
Figure 2:
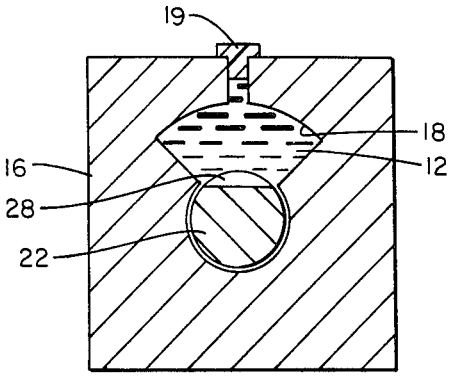
FIG. 2 is an end elevational view of the applicator taken generally along the line 2—2 in FIG. 1.
Figure 3:
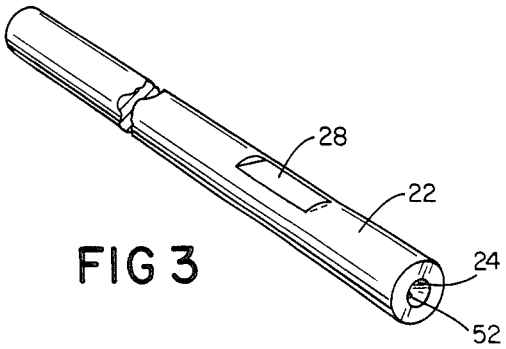
FIG. 3 is a perspective view of a component of the applicator shown in FIG. 1.

Reference is now made to the drawings, and in particular to FIGS. 1–4 wherein is shown a preferred embodiment of an applicator 10 for applying a coating of a photographic processing composition 12 to a length of flexible sheet material 14 which is to be subsequently superposed or laminated with a length of photographically exposed film so as to initiate the formation of a visible image, preferably in the film. The applicator 10 includes a housing 16, interior surfaces of which define a reservoir 18 for containing a supply of the photographic processing composition 12, and a longitudinally extending passageway 20 which runs completely through the housing 16. Mounted within an inlet of the reservoir 18 is a plug 19 while mounted within the passageway 20 for reciprocating movement is an elongate, cylindrically configured, member or roller 22 having indentations 24 and 26 in opposite ends thereof. The roller 22 is segmented intermediate its opposite ends to provide a recess 28 for receiving a predetermined quantity of the photographic processing composition 12 when the recess 28 is located in communication with the reservoir 12, as shown in FIG. 1. Preferably, the aforementioned predetermined quantity of photographic processing composition 12 is substantially equal to that necessary to coat a length of the sheet material 14 through a distance substantially equal to that of a photographically exposed area to be developed. Further, the recess 28 has a length which is substantially equal to the width of the sheet material 14 to be coated, as shown in FIG. 1.

Figure 4:
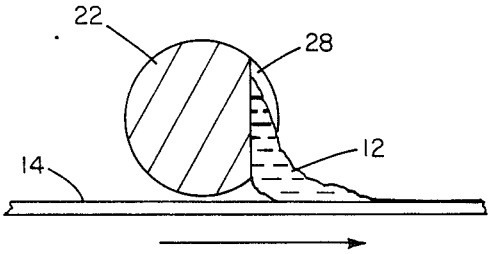
FIG. 4 is a schematic end view, in section, of the component shown in FIG. 3 during the time that it is applying a coating of the photographic processing composition to a length of sheet material.

The applicator 10 further includes means in the form of an inverted U-shaped member 30 for axially and rotationally moving the elongate member 22 along and about its longitudinal axis. The member 30 is adapted to move the elongate member 22 from a first position (solid line in FIG. 1), wherein at least a portion of the recess 28 is located within the reservoir 18, for receiving the aforementioned predetermined quantity of the processing composition 12 (preferably a viscous liquid), and a second position (broken line in FIG. 1), wherein at least a portion of the recess 28 is located exteriorly of the housing 16 and rotationally displaced (ninety degrees) from its orientation in said first position so as to enable the processing composition 12 to be coated onto the sheet material 14 due to the gravitational effect thereupon while the elongate member 22 is held out of contact with the sheet material 14. The member 30 includes a pair of vertically orientated legs 32 and 34 which are pivotally coupled at 36 and 38 to the opposite ends of a horizontally disposed portion 40 of the member 30. The portion 40 is threaded at 42 and cooperates with a fixedly mounted gear motor 44 for driving the member 30 between the aforementioned first and second positions. The free end of the leg 32 is provided with a conical shaped end 46 which is adapted to be rotatively received by the indentation 26 in one end of the elongate member 22. The free end of the leg 34 is provided with a rotatably supported conical shaped end 48 which is adapted to be received by the indentation 24 in the other end of the elongate member 22. The exterior surface of the end 48 is provided with a vane 50 which is adapted to cooperate with a similar vane 52 in the indentation 24 so as to rotate the elongate member 22 about its longitudinal axis. The end 48 also includes an interiorly formed beveled annular gear 54 which is adapted to be moved into mesh with a bevel gear 56 on a motor 58 as the elongate member 22 enters the second position (broken line position in FIG. 1). Thus as the elongate member is driven into the second position by the motor 44, the latter is deenergized and the motor 58 energized for a time sufficient to rotate the elongate member 22 through an angle of ninety degrees thereby enabling the processing composition 12 to flow onto the moving sheet material 14, as depicted in FIG. 4.

The housing 16 and/or the elongate member 22 may be constructed from inexpensive materials and thus be disposable upon the depletion of the processing composition 12 within the reservoir 18. To replace the housing 12 and the elongate member 22, one merely pivots the legs 32 and 34 outwardly from one another, removes the old housing and the elongate member and replaces the same with a new housing and/or elongate member.

The applicator 10 further includes a pair of ring seals 21 and 23 which are suitably fixed to the interior surface of the passageway 20 in surrounding relation to the elongate member 22 so as to prevent the leakage of the processing composition 12 from the reservoir 18 via the exterior surface of the elongate member 22. An outwardly facing surface of the ring seal 21 functions to wipe the surface of the elongate member 22 as it moves from the first position to the second position thus removing any contaminates which may be located thereupon and deposits the same in a space 25 located at the end of the passageway 20 while the outwardly facing surface of the ring seal 23 performs the same function as the elongate member 22 returns to the first position and deposits the contaminates in a space 27.

Figure 5:
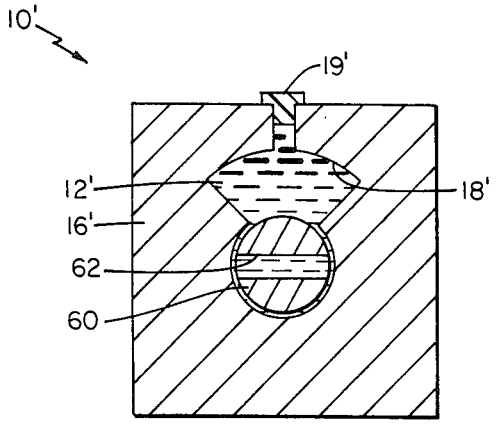
FIG. 5 is an end elevational view of an alternative embodiment of the invention.
Figure 6:
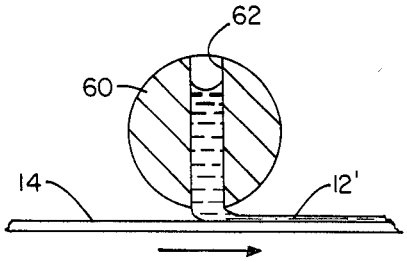
FIG. 6 is a schematic end view, in section, of a component of the applicator of FIG. 5 as it is applying a coating of the photographic processing composition to a length of sheet material.

Reference is now made to FIGS. 5 and 6 wherein is shown an alternative embodiment of an applicator 10'. The applicator 10' is identical to the applicator 10 described with reference to FIGS. 1–4 with the exception of the elongate member or roller 60. The roller 60 in turn is identical to the roller 22 previously described except that it has a recess 62 which extends completely through the roller 60 in a direction transverse to the roller's longitudinal axis. As with the recess 28 in the roller 22, the recess 62 has a length as measured along the roller's axis substantailly equal to the width of the sheet material to be coated. When the elongate member or roller 60 is located in its first position, as shown in FIG. 5, the recess 62 is in communication with the reservoir 18' and is filled with a predetermined quantity of the viscous processing liquid 12'. During a coating cycle, the elongate member 60 is moved axially to a second position wherein the recess 62 is located outside of the housing 16' and substantially in superposition with the sheet material 14. The a elongate member 60 is then rotated substantially ninety degrees about its axis into the position shown in FIG. 6 wherein it is maintained out of contact with the sheet material 14 by the previously described means for moving the elongate member between the first and second positions until the viscous processing liquid has been drained from the recess 62. The elongate member 60 is then rotated back into its original position and then axially returned to its first position. The coated length of sheet material 14 is moved to a station where it is temporarily laminated to a length of photographically exposed film so as to enable the viscous processing liquid 12' to be transferred to the film thereby initiating the formation of a visible image.

Figure 7:
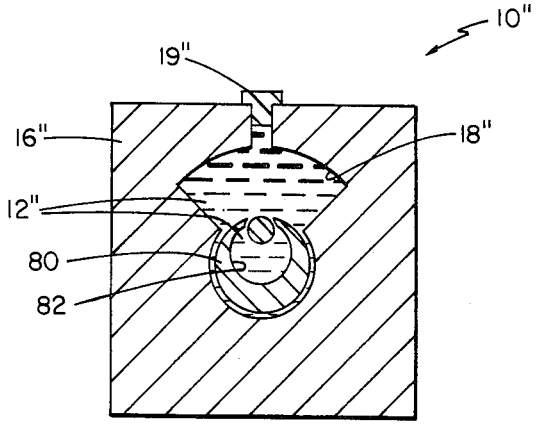
FIG. 7 is an end elevational view, in section, of still another embodiment of the present invention.
Figure 8:
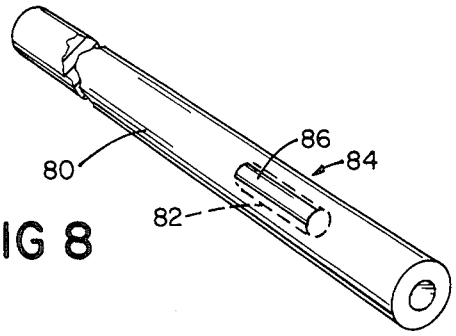
FIG. 8 is a perspective view of a component of the applicator shown in FIG. 7.
Figure 9:
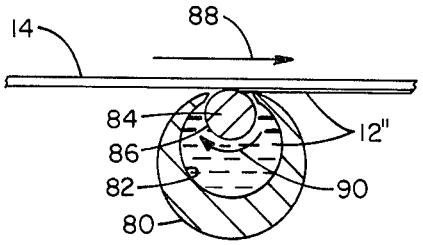
FIG. 9 is an end elevational view, in section, of a portion of the applicator of FIG. 7 as it is coating a length of sheet material with the photographic processing composition.

Reference is now made to FIGS. 7–9 wherein is shown still another embodiment of an applicator 10'' for applying a coating of the photographic processing composition 12'' to a length of flexible sheet material 14. The basic changes between the applicator 10'' and the applicator 10 is in the elongate member and that the moving means for the elongate member of the applicator 10'' does not include a means for rotating the elongate member about its longitudinal, as will be evident from the following description. Specifically, the applicator 10'' includes a housing 16'' having a reservoir 18'' for containing a quantity of photographic processing composition 12'', which may be a viscous or non-viscous liquid that is adversely affected by the oxygen in the ambient atmosphere. An elongate member 80 having a cylindrical configuration is mounted within a longitudinally extending passageway in the housing for movement between a first position, wherein a longitudinally extending recess 82 in the elongate member 80 is located in the reservoir 18'', and a second position, wherein recess 82 is located exteriorly of the housing 16'' and in alignment with a length of sheet material 14. Rotatably mounted within the recess 82 is a roller 84 having a coating surface 86 which is partially submerged in the processing composition 12'' and which surface 86 substantially forms a continuation of adjacent surfaces of the elongate member 80. The spacing between the coating surface 86 and the adjacent surfaces, while close, is still sufficient to permit the processing composition 12'' to flow into the recess 82 when the elongate member 80 is in the first position.

When it is desired to coat a length of the sheet material 14, the elongate member 80 is axially moved from its first position to its second position wherein, as shown in FIG. 9, the coating surface 86 of the roller 84 is located below and in engagement with the sheet material 14. As the sheet material 14 is moved in the direction of the arrow 88 it causes the roller 84 to rotate in the direction of the arrow 90 thus applying a coating of the processing composition 12'' to the underside of the sheet material 14 which is then superposed or laminated with and exposed area of a length of film. The roller 84, as with the recesses 28 and 62, has a length substantially equal to the width of the sheet material to be coated.

Since certain changes may be made in the above described invention without departing from the scope thereof, it is intended that all matter contained in the above description or shown in the accompanying drawings shall be interpreted as illustrative and not in a limiting sense.

What is claimed is:

1. An applicator for applying a coating of photographic processing composition to a length of sheet material, said applicator comprising:

a housing having means defining a reservoir for containing a supply of photographic processing composition in a substantially non-oxidative environment;

means for defining a passageway communicating between said reservoir and the exterior of said housing;

an elongate member mounted within said passageway, said elongate member including means for receiving a predetermined quantity of the photographic processing composition located within said reservoir; and means for axially and rotationally moving said elongate member along and about its longitudinal axis from a first position, wherein at least a portion of said receiving means is located in said reservoir, for receiving the quantity of processing composition, and a second position, wherein at least a portion of said receiving means is located exteriorly of said housing and rotationally displaced from its orientation in said first position so as to enable the photographic processing composition to be coated onto the sheet material.

2. An applicator as defined in claim 1 wherein said receiving means comprises a recess.

3. An applicator as defined in claim 2 wherein said recess has a length substantially equal to the width of the sheet material to be coated.

4. An applicator as defined in claim 3 wherein said elongate member comprises a roller.

5. An applicator as defined in claim 1 wherein said receiving means comprises a slot which extends completely through said receiving means in a direction generally transverse to its longitudinal axis.

6. An applicator as defined in claim 5 wherein said slot has a length substantially equal to the width of the sheet material to be coated.

7. An applicator as defined in claim 6 wherein said elongate member comprises a roller.

8. An applicator as defined in claim 1 wherein said moving means is adapted to maintain said elongate member out of contact with the sheet material during the coating of the processing composition thereupon.

9. An applicator for applying a coating of photographic processing composition to a length of sheet material prior to superposing such coated length with another sheet material so as to initiate the formation of a visible image within one of the sheets, said applicator comprising:

a housing having means defining a reservoir for containing a supply of photographic processing composition in a substantially non-oxidative environment;

means for defining a passageway communicating between said reservoir and the exterior of said housing;

an elongate member mounted within said passageway, said elongate member including a recess for receiving a predetermined quantity of the photographic processing composition located within said reservoir;

a roller mounted in said recess for free rotation about its longitudinal axis, said roller having a coating surface which is at least partially submerged in the processing composition located in said recess and which substantially forms a continuation of adjacent surfaces of said elongate member; and means for axially moving said elongate member along its longitudinal axis from a first position, wherein at least a portion of said recess is located in said reservoir, for receiving the quantity of processing composition, and a second position, wherein said roller is located exteriorly of said housing whereat the photographic processing composition may be coated onto the sheet material by moving the latter in contact with said surface of said roller.

10. An applicator as defined in claim 9 wherein said roller has a length substantially equal to the width of the sheet material to be coated.

11. An applicator as defined in claim 10 wherein said elongated member has a generally cylindrical configuration.

* * * * *